US005700324A

United States Patent [19]

Kim

[11] Patent Number: 5,700,324

[45] Date of Patent: Dec. 23, 1997

[54] MANUFACTURING APPARATUS OF COMPOSITE FILTER

[75] Inventor: Chang Sik Kim, Kyongki-Do, Rep. of Korea

[73] Assignee: Samsung Electro-Mechanics Co., Ltd., Kyongki-do, Rep. of Korea

[21] Appl. No.: 561,186

[22] Filed: Nov. 21, 1995

[30] Foreign Application Priority Data

Nov. 22, 1994 [KR] Rep. of Korea ..... 1994-30932

[51] Int. Cl.[6] ..... B05C 19/00

[52] U.S. Cl. ..... 118/407; 118/641; 118/58; 118/67; 118/68; 118/419; 118/423; 118/428; 427/58; 427/117; 427/180

[58] Field of Search ..... 333/181, 12; 336/175; 118/407, 419, 423, 428, 641, 58, 67, 68; 427/58, 96, 118–120, 180, 205

[56] References Cited

U.S. PATENT DOCUMENTS

| | | | |
|---|---|---|---|
| 2,707,703 | 5/1955 | Dorst | 427/119 |
| 3,756,852 | 9/1973 | Scheetz et al. | 427/58 |
| 3,967,000 | 6/1976 | Klein et al. | 427/58 |
| 4,013,807 | 3/1977 | Putney | 118/428 |
| 4,104,416 | 8/1978 | Parthasarathy et al. | 427/118 |
| 5,200,720 | 4/1993 | Yi | 333/181 |

FOREIGN PATENT DOCUMENTS 90-19258 1/1994 Rep. of Korea .

*Primary Examiner*—Laura Edwards
*Attorney, Agent, or Firm*—Lowe, Price, LeBlanc & Becker

[57] ABSTRACT

A manufacturing apparatus of composite filter used as a bead core filter for preventing an electomagneric interference. Particularly, it comprises an element pre-heating section for pre-heating the element through the heaters by conveying vertically the filter element by top and bottom rollers, a coating element coating section for guiding the pre-heated filter element through a guide shaft and passing through a top of the powder disher whereby coating by soaking to the coating agent, and a hardening section for passing in a wave form so as to harden the filter element finished the coating. According to this, not only an influence of the coating agent of the composite filter element is minimized so that each element maintains mutually same electromagnetic characteristics, but also a mechanical strength of the filter element according to the coating of the powder is improved and a coating operation of precise thickness can be executed, and a process line in case of manufacturing the composite filter element is made to be vertical, and the coating process by a coating device is minimized whereby a length of whole lines can be remarkably decreased, and according to this, a workability and a productivity can be improved.

6 Claims, 5 Drawing Sheets

PRIOR ART

MANUFACTURING APPARATUS OF COMPOSITE FILTER

BACKGROUND OF THE INVENTION

The present invention relates to a manufacturing apparatus of composite filter used as a bead core filter for preventing an electromagnetic interference (hereinafter called as EMI), and more particularly to a manufacturing apparatus of composite filter element which comprises: a filter element coating section for executing an element pre-heating through a heater with vertically conveying a filter element by top and bottom roller, and guiding the pre-heated filter element through a guide shaft and passing through a powder disher top whereby soaking and coating to a coating agent; and a hardening section for passing by a wave form so as to make the filter element completed to coat to be hardened; so that due to completion of the composite filter, an influence of the coating agent of the composite filter element is minimized, so that not only each constituting element maintains same electromagnetic characteristic together, but also a mechanical strength of the filter element according to the coating of the powder is improved and simultaneously a coating operation of precise thickness can be executed.

In general, the electromagnetic interference EMI generated between an electronic instrument and a circuit is propagated through a conductor wire or an air and generates a noise to a circumferential instrument and circuit so as to make error operation.

Accordingly, in order to eliminate the electromagnetic interference as above, a three terminal type filter made by combining a ferrite bead or capacitor and the ferrite is mainly used.

Heretofore, mainly three terminal capacitor has been generally used for preventing and decreasing a noise of relatively high frequency, and two terminal type capacitor can greatly obtain theoretically a decreasing effect of noise as going to low frequency, but practically there is a problem such as a remaining inductance according to a lead wire and structure of electrode or a floating capacitance between the wire windings, and a resonance point is appeared from several MHz to several tens MHz, and there has been a problem that a noise eliminating effect is rapidly decreased by a high frequency.

Accordingly, as a substitutional part of the noise as above, a filter assembled only by a ferrite is used or else a filter combined to integral type with a piled capacitor or a magnetic element is used.

Namely, because the ferrite core is generally small in an eddy current loss, and it has high impedance up to high frequency, and it is cheap, the noise can be eliminated by a relatively simple structure, and a side effect such as distortion of signal or abnormal oscillation is less.

And, in case of three terminal filter combined with the ferrite and capacitor, a high attenuating effect is obtained at high frequency.

FIG. 1 is a view showing a general EMI ferrite filter, and which is structured by an EMI filter 30 of a state adhered with lead wire 20 between ferrite cores 10, and this is formed with a coating layer 40 containing an epoxy powder resin.

In a manufacturing apparatus of a conventional EMI filter element related with such technique, as shown in FIG. 2 and FIG. 3, it is made such that a lead wire 20 of the EMI filter 30 is bent and this is executed by a preheating operation through a filter heater 51, the EMI filter 30 completed with preheating is executed with a coating operation through an epoxy powder welded with head portion through a rotating body 62 provided within a powder containing means 61 of a coating device 60, and the filter 30 completed with the coating is advanced to a hardening device 52 whereby hardened.

In above description, the coating method of the EMI filter 30 being a composite filter, as shown in FIG. 3, is progressed by a downward accumulating system, and the ingredient of the coating agent is roughly divided to a powder and liquid, and its ingredient is also divided to an epoxy group and phenol group.

Since a conventional manufacturing apparatus of composite filter (EMI filter) is made by a linear process line and a drying process line, a contacting surface of the epoxy powder with a part is little, therefore a thickness adjustment of the coating agent is difficult, and the coating method is to secure a minimum coating thickness through multiple coating processes (approximately over four times), and thereby a linear process line was required.

And, there has been many problems that a cost decreasing is required with strengthening an adherence and mechanical strength by adjusting main ingredient of powder epoxy group, and a storing process management of the powder epoxy is difficult, and since a post process is separately divided, a process loss becomes larger.

OBJECT AND SUMMARY OF THE INVENTION

Therefore, the present invention is to solve such conventional various problems as described above, and it is an object of the present invention to provide a manufacturing apparatus of composite filter element which is made such that not only an influence of a coating agent of filter element is minimized and that mutually same electro-magnetic characteristic is maintained, but also a mechanical strength of filter element according to the coating of the powder is improved and a coating operation of precise thickness can be executed.

Another object of the present invention is to provide a manufacturing method of composite filter element in which a process line is made to vertical in case of manufacturing a composite filter element, and a coating process by coating machine is minimized so that a length of whole line can be remarkably decreased, and accordingly a workability and productivity can be improved.

As a mechanical means for obtaining above object, the present invention is made with a manufacturing apparatus of composite filter element comprising:

an element pre-heating section for conveying vertically a filter element by top and bottom rollers and executing a pre-heating of filter element by a heater, an element coating section in which a guide shaft for guiding a pre-heated filter element to be inclined by said element pre-heating section is provided to one side of an element feeding device, and the filter element is passed through a powder disher top portion of powder guide top by said guide shaft whereby soaking and coating a coating agent, and a hardening section in which a several number of top and bottom rollers are provided so that the filter element passes in wave form to an end portion provided with said element pre-heating section and the element coating section alternately in multiple.

DETAILED DESCRIPTION OF THE INVENTION

Hereinafter, a preferred embodiment of the present invention will be described more in detail with reference to the accompanying drawings.

Figure 1:
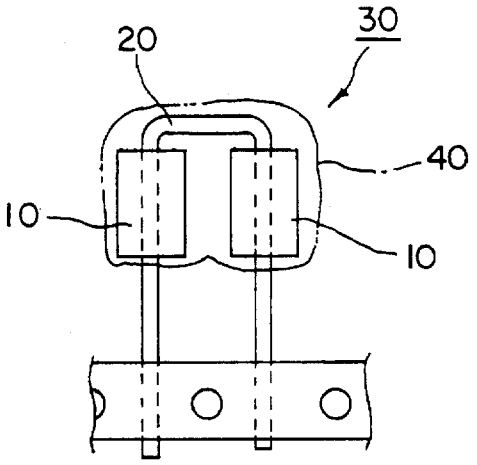
FIG. 1 PRIOR ART
FIG. 1 is a drawing which shows a general composite filter (EMI filter) element.
Figure 2:
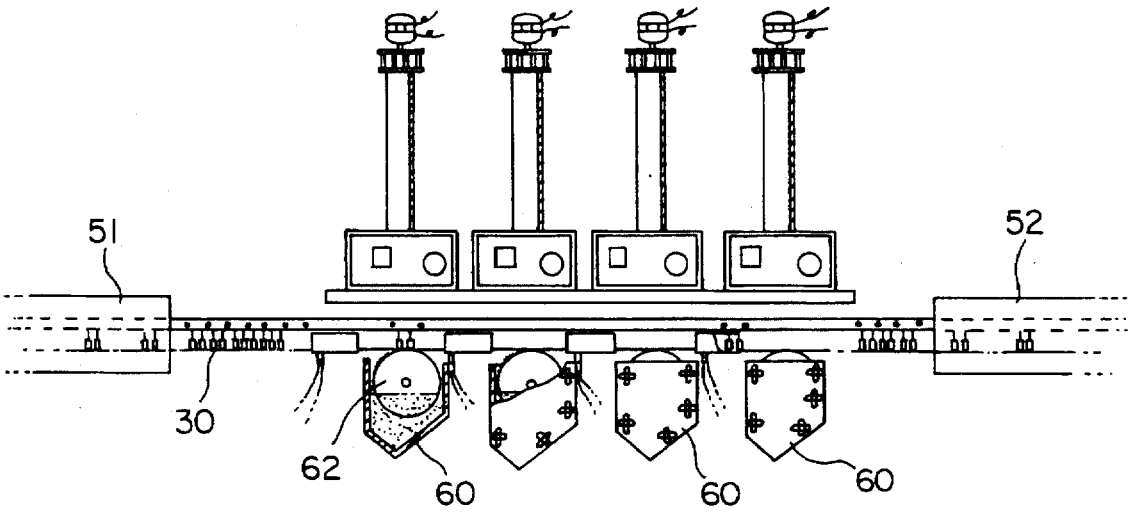
FIG. 2 PRIOR ART
FIG. 2 is a schematic structural view of a conventional filter element manufacturing apparatus.
Figure 3:
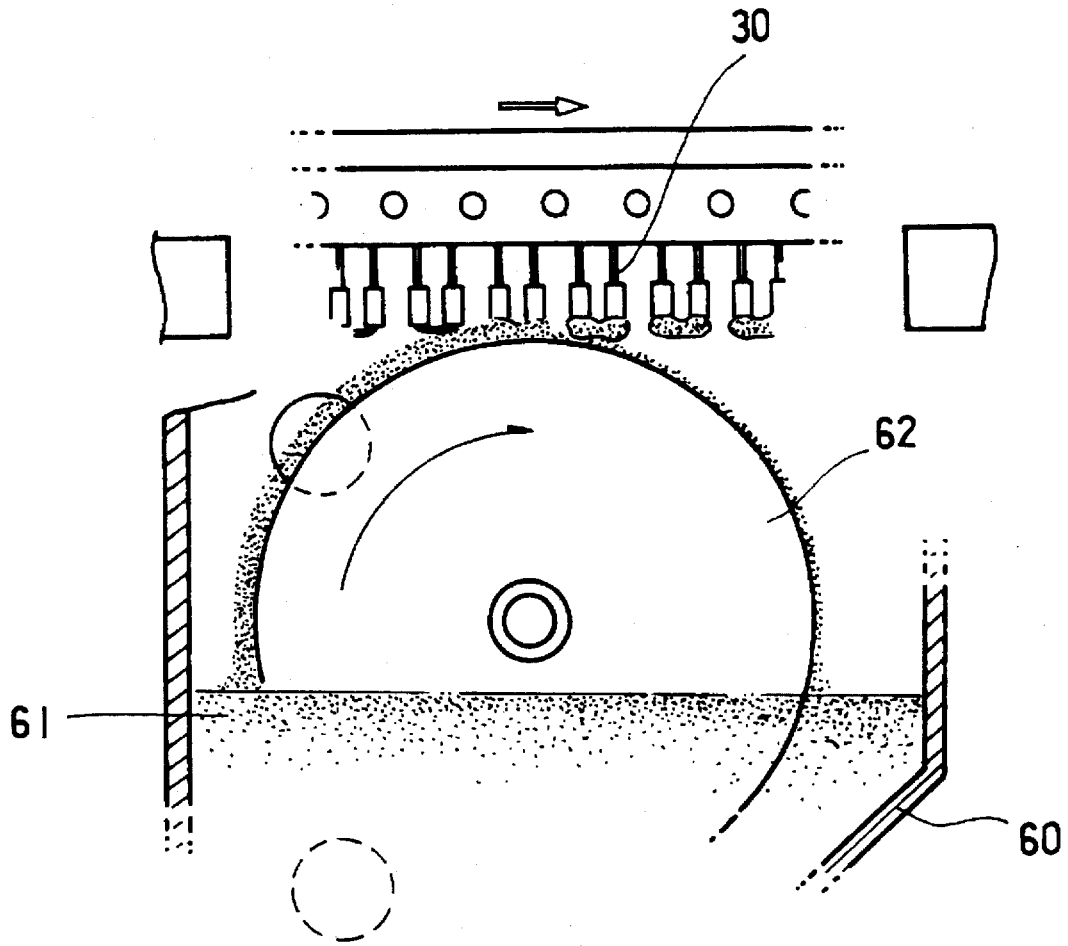
FIG. 3 is a structural view of essential part of conventional filter element coating section.
Figure 4:
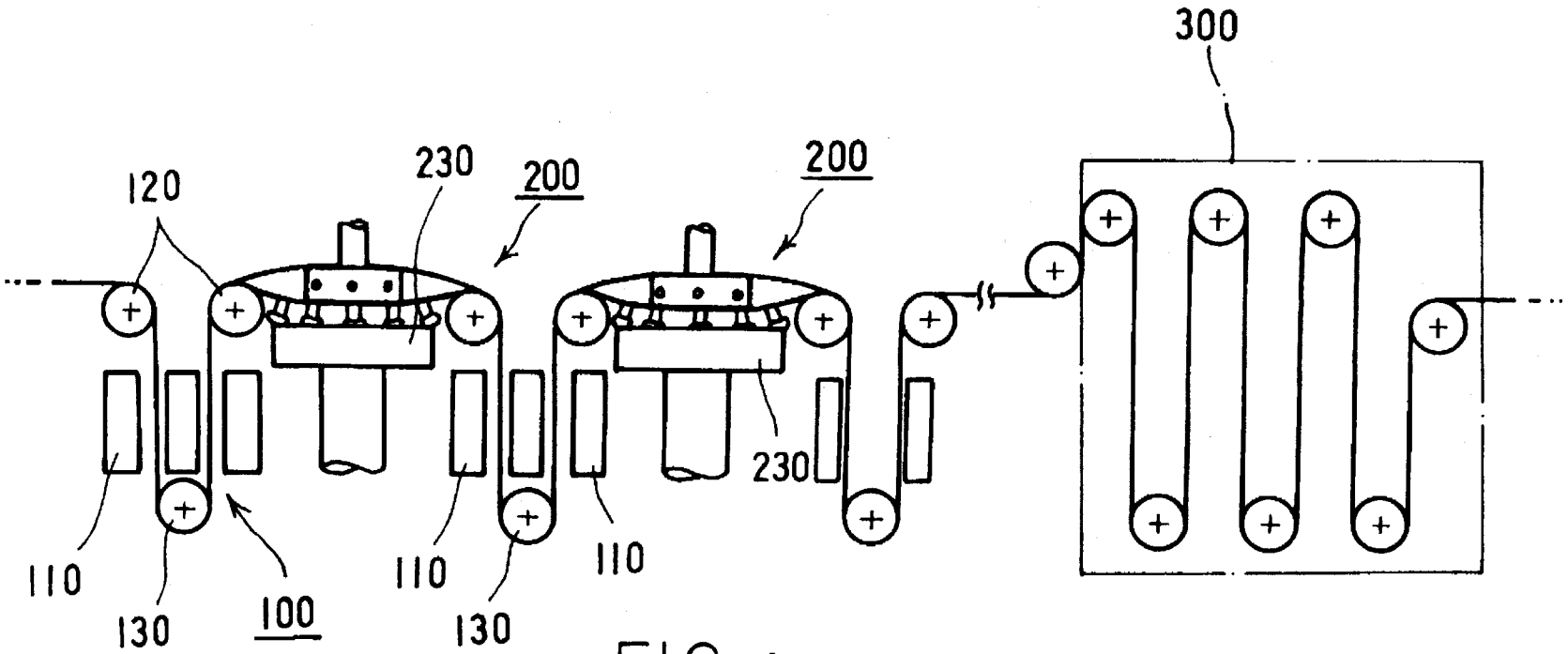
FIG. 4 is a schematic structural view of a composite filter manufacturing apparatus in accordance with the present invention.
Figure 5:
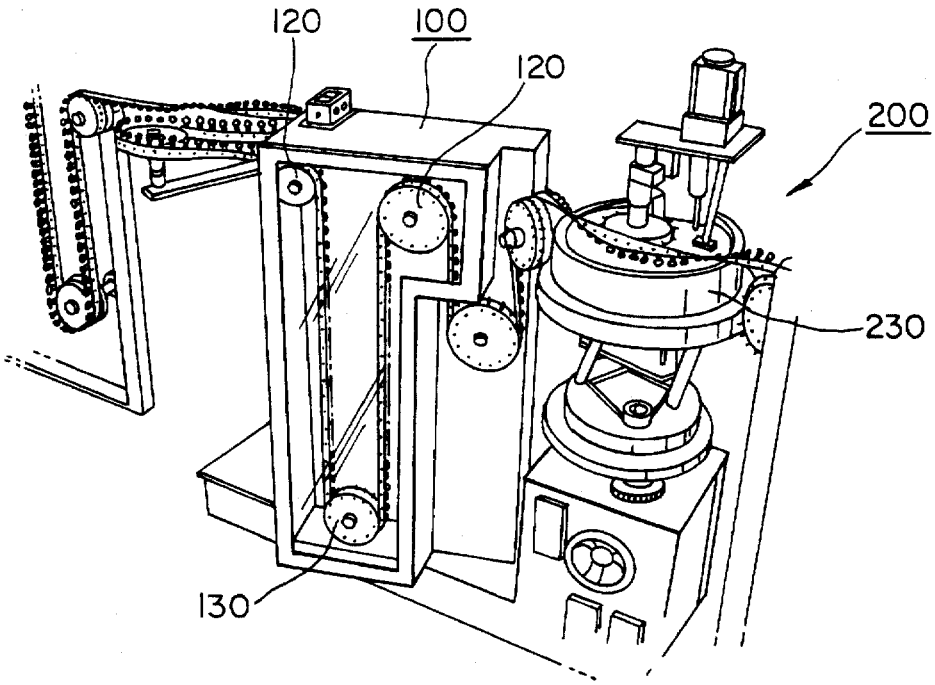
FIG. 5 is a view showing an element pre-heading section in accordance with the present invention.
Figure 6:
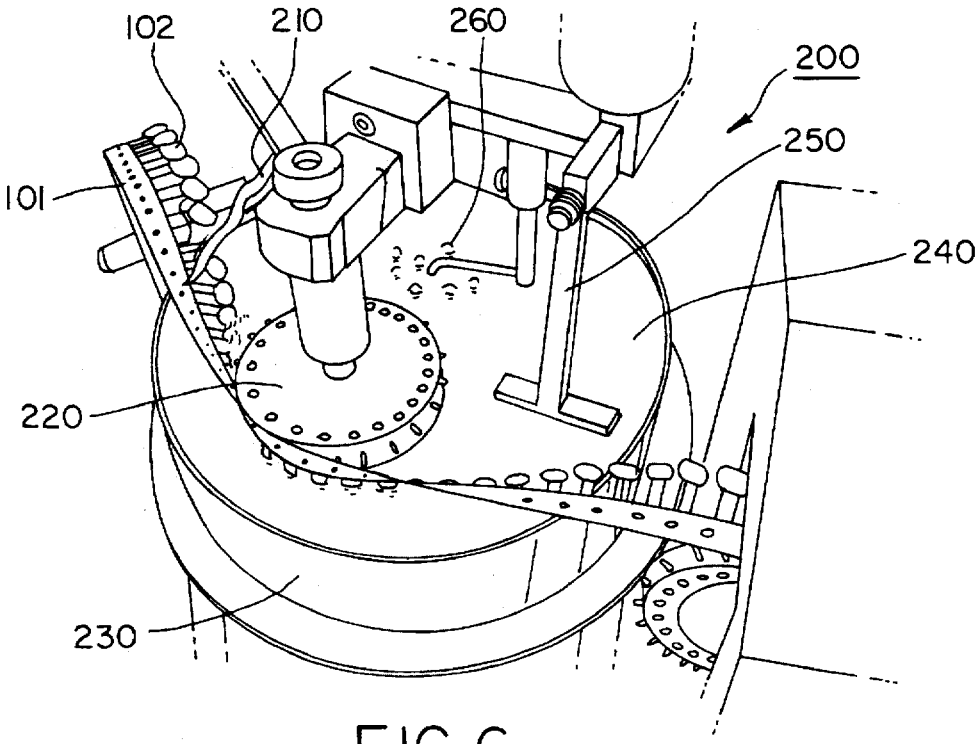
FIG. 6 is a view showing an element coating section of the present invention.

FIG. 4 is a schematic structural view of a composite filter manufacturing apparatus in accordance with the present invention, and FIG. 5 is a view showing an element preheating section of the invention and FIG. 6 is a view showing an element coating section of the invention, and the present invention is constructed by an element preheating section 100, an element coating section 200 and an element hardening section 300.

The element pre-heating section 100 in which a filter element 102 taped with lead wires and arranged in equidistant to a paper strap 101 of roll paper type is provided with a several heaters 110 in vertical, and one or more than two of top and bottom rollers 120, 130 are provided at its top and bottom side end portions so that the filter element 102 is passed between said heater 110.

And, the element coating section 200 for soaking and coating the filter element 102 passed through said element pre-heating section 100 to the coating agent is provided such that a guide shaft 210 for guiding a pre-heated filter element 102 to be inclined by said element pre-heating section 100 is provided to one side of an element feeding device 220, and the filter element 102 is passed through a powder disher 230 top portion of powder guide top by said guide shaft whereby soaking and coating a coating agent.

The element feeding device 220 for driving to rotate so as to convey by clamping a paper strap 101 of the filter element 102 is provided to top side of the powder disher 230 provided to said element coating section 200, and to which top and one side there is arranged with the guide shaft 210 so as to make the conveying filter element 102 to be temporarily soaked to the coating agent 240 within the powder disher 230 in an inclined state.

And, a surface horizon maintaining guide piece 250 for leveling the surface of the coating agent 240 is provided to another side of said powder disher 230.

And, a number of air inlet grooves 260 are formed at bottom portion of said powder disher 230 so as to make the powder soaked to bottom to be able to move to top of the powder disher 230.

Said element pre-heating section 100 and the element coating section 200 are repeatedly provided alternately in multiple so as to several times repeat the pre-heating and coating of the filter element 102.

And, an element hardening section 300 making the filter element 102 finished the coating to be hardened is made by a structure in which a several top and bottom rollers 310,320 are provided at rear end provided with said element preheating section 100 and the element coating section 200 alternately in multiple so as to make the filter element 102 to be passed in wave form.

Explaining an operation and effect of the present invention made by a structure as these, they will be as follows.

As shown from FIG. 4 to FIG. 7, the filter element 102 in which the lead wires are taped and equidistantly arranged to a paper strap 101 of roll paper type is continuously fed to the element pre-heating section 100 and simultaneously a several heaters 110 are provided, and one or more than two top and bottom rollers 120,130 are provided at its top and bottom side ends so that the filter element 102 is passed between said heaters 110 and thereby the filter element 102 is continuously passed by a rotational driving of said top and bottom rollers 120,130 so as to be sufficiently pre-heated.

The filter element 102 sufficiently finished with the preheating through said element pre-heating section 100 is provided with the element feeding device 220 for rotating and driving so as to convey by clamping the paper strap 101 of the filter element 102 to top side of the powder disher 230 provided to said element coating section 200 so as to direct to the powder disher 230, and at this moment, to one side of top of said element feeding device 220, as shown in FIG. 6, the filter element 102 arranged with the guide shaft 210 and conveyed is made to be an inclined state so as to be temporarily soaked to the coating agent 240 within the powder disher 230.

And, the surface horizon maintaining guide piece 250 for leveling the surface of the coating agent 240 is provided to another side of said powder disher 230 so that the surface of the coating agent 240 is maintained to be always even.

Said element pre-heating section 100 and the element coating section 200 are provided alternately in multiple, for instance, in two to three so as to repeat the pre-heating and coating of the filter element 102 in two to three times, so that the coating is executed to the filter element 102 with a predetermined thickness, and at this moment, the coating of the coating epoxy group powder is executed by inclining said filter element 102, so that an influence of the coating agent 240 is minimized, and according to this, uniform thickness of coating can be obtained, and each constituting element maintains mutually same electromagnetic characteristics.

Figure 7:
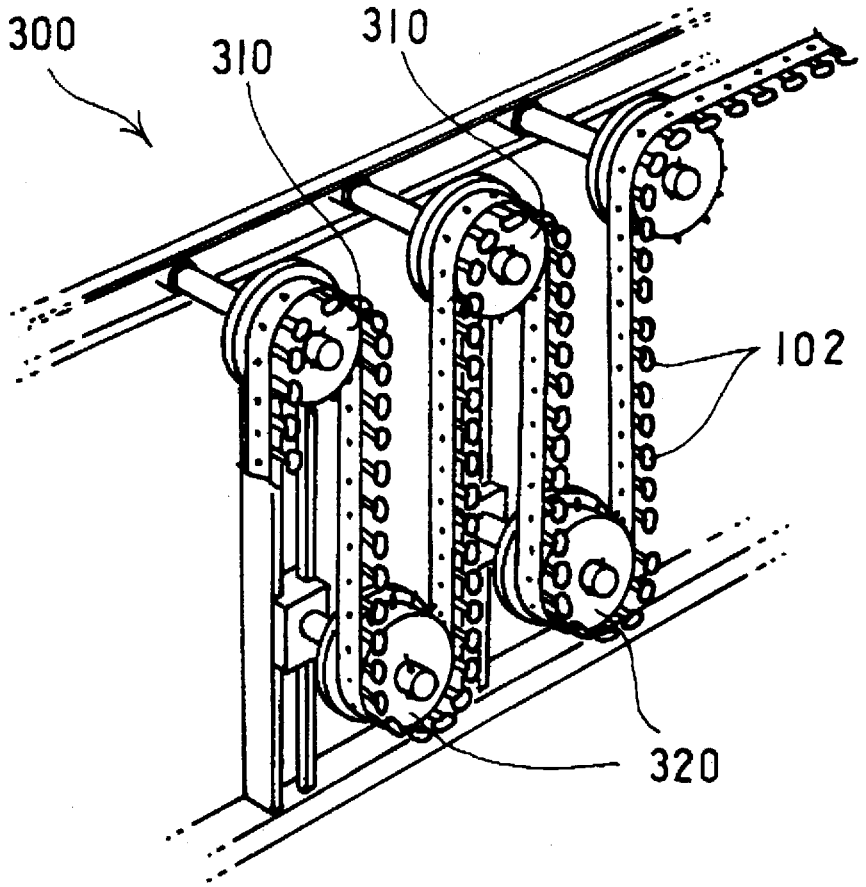
FIG. 7 is a view showing an element hardening section of the present invention.

Subsequently, the filter element 102 finished the coating is provided with the element hardening section 300 provided with several top and bottom rollers 310,320 so that the filter element 102 is passed in wave form to a rear end provided alternately in multiple with said element preheating section 100 and the element coating section 200, and as in FIG. 7, the filter element 102 is conveyed by having a wave form in vertical so as to be sufficiently hardened by a rotating and driving of the top and bottom rollers 310,320, and a paper fold marking can be executed in a sufficiently hardened state as described above.

Thus, in accordance with the manufacturing apparatus of the composite filter element according to the present invention, not only an influence of coating agent of the composite filter element is minimized so that each constituting element maintains mutually same electromagnetic characteristic, but also a mechanical strength of the filter element according to the coating of the powder is improved and simultaneously the coating operation of precise thickness can be executed, and the process line is made to be vertical in case of manufacturing the composite filter element, and the coating process by the coating device is minimized whereby the length of the whole line can be remarkably decreased, and according to this, there is an excellent effect capable of improving a workability and a productivity.

The present invention is shown and described in relation to a particular embodiment, however it should be noted that those who skilled in this art can easily know that the present invention can be variously changed and modified within a limit without departing from a spirit and extent of the present invention described in following claims.

What is claimed is:

1. An apparatus for treating an electrical bead core element, comprising:

an elongated support strap for supporting at least one bead core element adhered thereto;

a pre-heating section including plural heaters disposed in a vertical arrangement having top rollers and a bottom guide roller disposed therein to enable a continuously fed strap supported bead core element to be passed between said heaters and thereby be preheated;

a coating section disposed adjacent said pre-heating section including a coating tank for containing a powder coating material; a guide shaft disposed above said coating tank; and a hardening section disposed adjacent said coating section including plural top and bottom rollers so that said strap supported bead core element is moved in a wave form past said pre-heating section and the coating section alternately.

2. The apparatus for treating an electrical bead core as defined in claim 1, further comprising an element feeding device for rotating and driving said strap supported bead core element and said coating section including a powder dish having a coating agent therein.

3. The apparatus for treating an electrical bead core as defined in claim 1, further comprising a surface horizon maintaining guide piece in communication with said coating tank for leveling the surface of the coating agent in said coating tank.

4. The manufacturing apparatus for treating an electrical bead core as defined in claim 2, wherein said powder disher includes a number of inlet grooves.

5. The manufacturing apparatus for treating an electrical bead core as defined in claim 1, further comprising additional element pre-heating sections and additional element coating sections which are arranged alternately.

6. A manufacturing apparatus of composite filter as defined in claim 5, wherein there are at least three of said element pre-heating sections and at least three of the element coating sections repeatedly provided.

* * * * *